US005901790A

United States Patent [19]

Kilbarger

[11] Patent Number: 5,901,790

[45] Date of Patent: May 11, 1999

[54] EARTH MOVER AND ATTACHED VIBRATORY SCREEN

[76] Inventor: Edward F. Kilbarger, 31392 Bowland Derr Rd., Logan, Ohio 43138

[21] Appl. No.: 09/006,558

[22] Filed: Jan. 13, 1998

[51] Int. Cl.[6] ..... E02F 1/00

[52] U.S. Cl. ..... 172/32; 37/142.5

[58] Field of Search ..... 37/142.5, 403, 37/104, 903; 171/16, 132; 172/32, 33, 40; 405/179; 414/722, 912; 209/240, 241, 420, 421, 47, 393

[56] References Cited

U.S. PATENT DOCUMENTS

| | | | |
|---|---|---|---|
| 1,358,113 | 2/1920 | Carlson . | |
| 2,100,997 | 3/1937 | Mayfield | 97/10 |
| 2,783,698 | 3/1957 | Bambi | 97/10 |
| 3,701,422 | 10/1972 | Downey | 209/241 |
| 4,494,611 | 1/1985 | Alvarez | 172/32 |
| 5,195,260 | 3/1993 | Osadchuk | 37/142.5 |
| 5,771,612 | 6/1998 | Lynch | 37/142.5 |

*Primary Examiner*—Thomas B. Will
*Assistant Examiner*—Robert Pezzuto
*Attorney, Agent, or Firm*—John L. Gray; Kegler, Brown, Hill & Ritter, L.P.A.

[57] ABSTRACT

An earth mover provided with a continuous bucket-type loader which lifts earth onto a screen on the earth mover which vibrates in order to separate soil from rocks and other debris with the soil being collected in the earth mover as the earth mover moves along and the rocks and other debris being discharged from the rear of the earth mover on ground over which the earth mover has just moved.

4 Claims, 2 Drawing Sheets

EARTH MOVER AND ATTACHED VIBRATORY SCREEN

BACKGROUND OF THE INVENTION

Earth movers of the type comprising a tractor pulling an earth carrier which is provided with a scoop therebelow which can scoop up earth into the carrier or alternatively scoop up earth which is dumped into the carrier by means of an endless belt are well known and made by a number of different manufacturers. The earth thus scooped up often times can have a significant amount of rock and other debris therein. In order to separate this from the soil in the earth, the present state of the art involves collecting the earth in the soil carrier, going to a stationary screen and dumping the earth containing the rocks therein. Then a track hoe is used to load the earth thus collected onto the screen and an end loader is used to stockpile the screened soil which is separated from the rocks and other debris in the earth. Thus, four pieces of equipment and four operators are used to collect the earth and separate the rocks and other debris from the soil.

BRIEF SUMMARY OF THE INVENTION

Applicant has devised a device which includes the addition of a screen to a conventional earth mover's earth carrying portion, preferably vibratory, which is sloped, so that as the earth is dumped into the earth carrier attached to the tractor by the endless belt, it is dumped onto the screen. The pieces of soil go through the screen and the rocks and other debris fall behind the earth mover.

It is therefore an object of this invention to provide a combination earth mover and screening device for separating rocks and other debris from soil being placed in said earth mover.

It is a further object of this invention to provide such 1 device which will eliminate a number of pieces of equipment and their operators in collecting, separating, and moving earth from one place to another.

These, together with other objects and advantages of the invention, will become readily apparent to those skilled in the art from the following detailed(d description of the invention and the accompanying drawings.

DETAILED DESCRIPTION OF THE INVENTION

Figure 1:
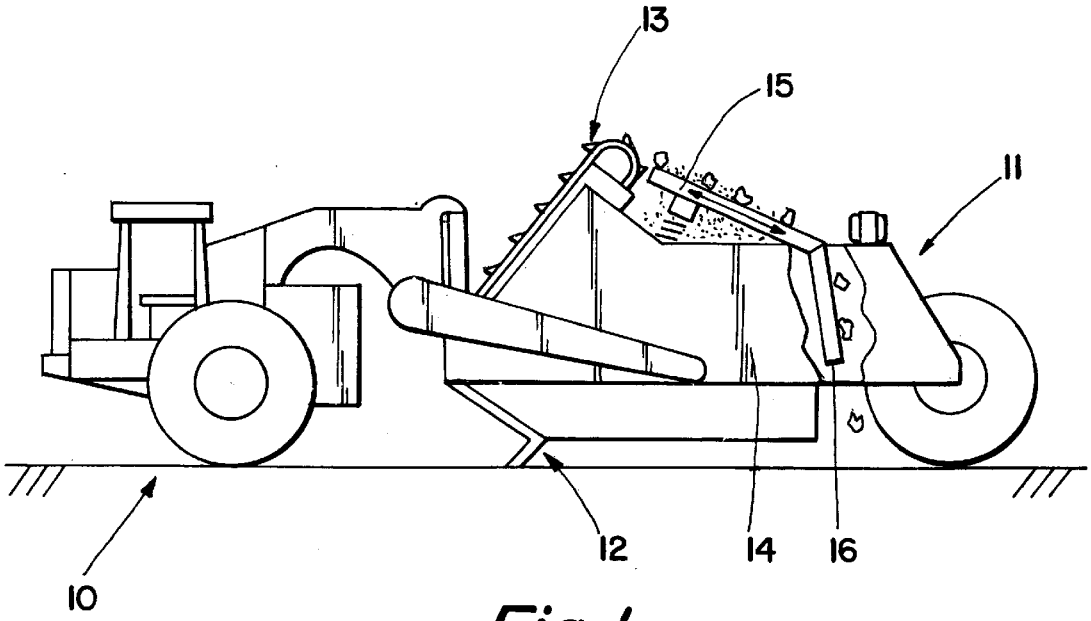
FIG. 1 is a side elevation view of Applicant's invention.

Referring now to FIG. 1, an earth mover is shown comprising a tractor 10 and an earth carrier 11. Earth carrier 11 is provided with a scoop 12 shown in extended position in order to scoop up the earth from the ground. The earth thus loosened is collected and moved by the endless belt 13 and discharged into the body 14 of the earth carrier 11. First, however, the earth is dumped on the screen 15, which preferably is vibrating, so that the soil will pass into the body 14 and the rocks and other debris will be discharged down the chute 16 onto the ground.

Figure 2:
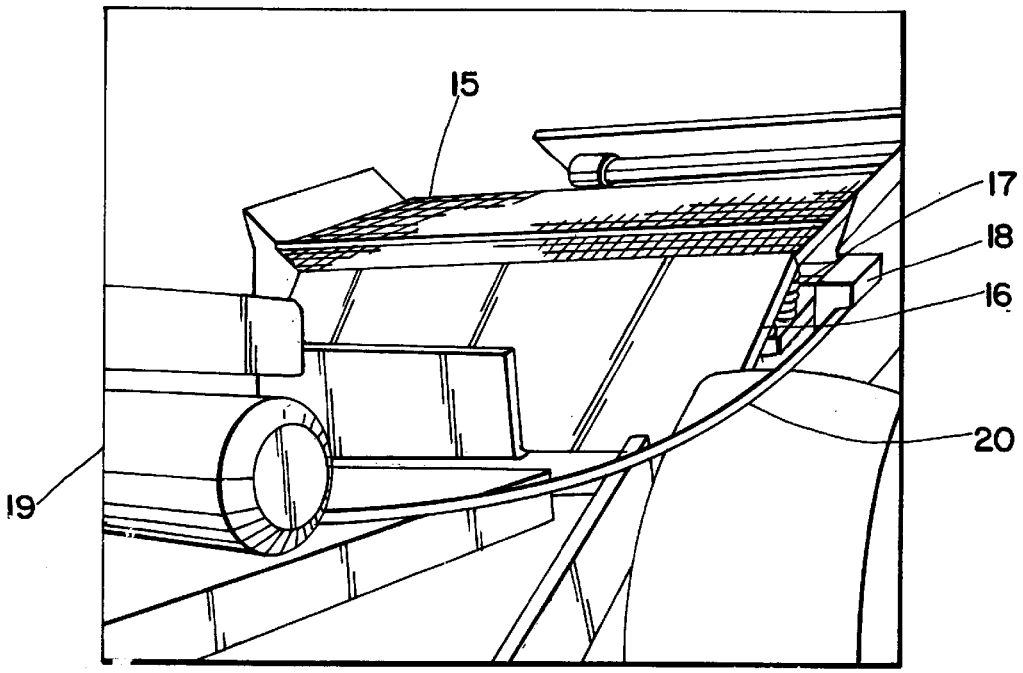
FIG. 2 is a perspective view looking at the rear of the invention and showing the screen and the exit ramp from the screen.

Referring more particularly to FIG. 2, the screen 15 is shown and it is supported on spring 17 spaced around the periphery of the screen and the screen is vibrated by means of a hydraulic motor 18 which is provided with hydraulic power from the unit 19. The rocks and other debris separated from the soil by the screen 15 will be discharged down the chute 16.

Figure 3:
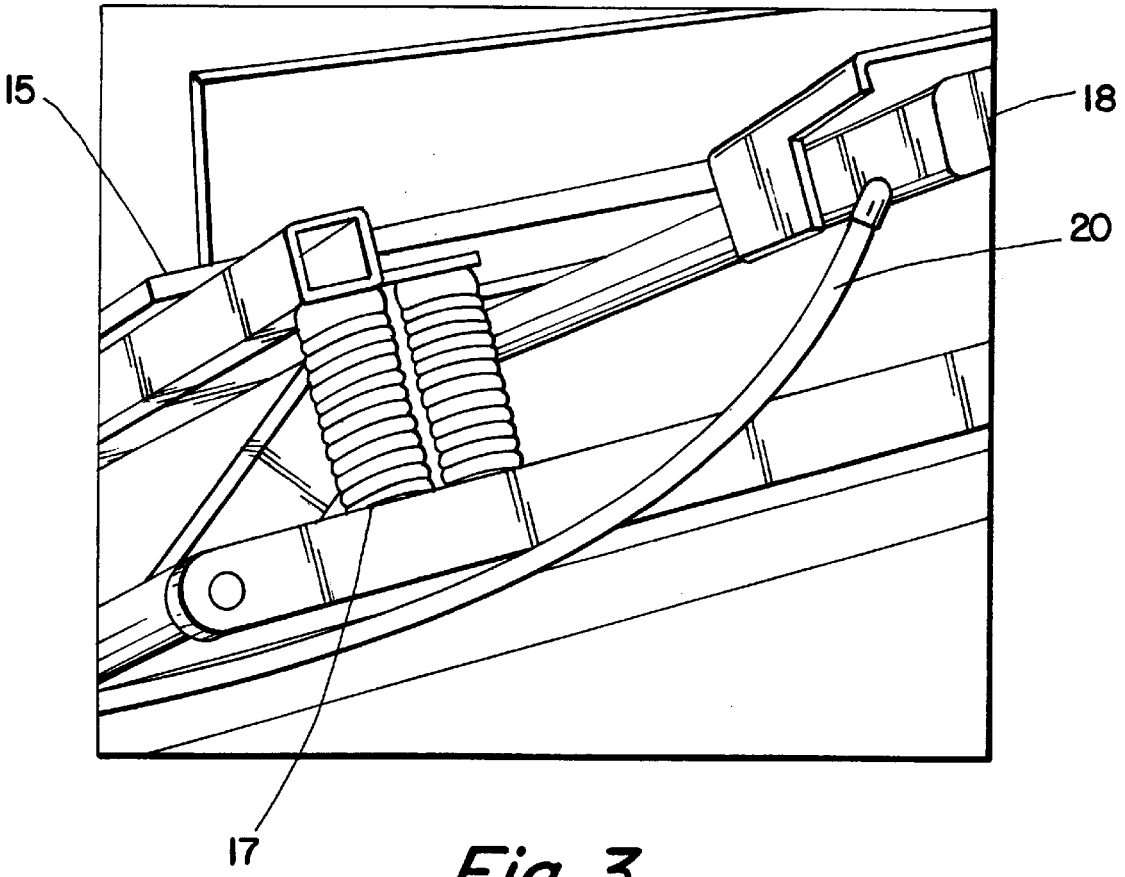
FIG. 3 is a detail of one of the methods of vibrating the screen.

FIG. 3 is a detailed drawing showing the screen 15, the springs 17 and the hydraulic line 20 connected to the vibratory motor 18. Obviously, other mechanisms can be used to vibrate the screen or, if desired in some situations, the vibratory mechanism may be omitted and the movement of the earth mover will be sufficient to cause separation of the soil from the rocks and other debris.

While this invention has been shown and described with respect to a detailed embodiment thereof, it will be understood by those skilled in the art that various changes in from and detail thereof may be made without departing from the scope and spirit of the claims of the invention.

What is claimed is:

1. An earth mover comprising:

a tractor;

an earth carrier attached to said tractor;

said earth carrier being provided with a scoop on the underside thereof which engages the ground to loosen and raise the earth therefrom;

a continuous bucket type loader which lifts said loosened earth and dumps it into said earth carrier; and a screen covering said earth carrier so positioned on the top of said earth carrier so that said earth being discharged from said continuous bucket type loader must pass over said screen, and so that soil in said earth will pass through said screen and be retained in said earth carrier and any rocks and debris associated with said earth will not pass through said screen and will be discharged from the rear of said earth mover as said earth mover moves forward, thus separating rocks and other debris from said soil and retaining said soil in said earth mover and discharging said rocks and said other debris at the rear of said earth mover on ground over which the earth mover has just moved.

2. The earth mover of claim 1, further comprising:

vibratory means attached to said screen for vibrating said screen to assist in the separation of rocks and other debris from said soil.

3. The earth mover of claim 1, wherein said screen is sloped downward toward the rear of said earth carrier.

4. The earth mover of claim 1, additionally comprising:

a chute to direct said rocks and other debris from said screen to the rear of said earth carrier.

* * * * *